United States Patent [19]

Suzuki et al.

[11] Patent Number: 5,037,217

[45] Date of Patent: Aug. 6, 1991

[54] DOT-MATRIX IMPACT PRINTER USING PIEZOELECTRIC ELEMENTS FOR ACTIVATING PRINT WIRES

[75] Inventors: Masashi Suzuki; Hideyuki Matunaga, both of Nagoya, Japan

[73] Assignee: Brother Kogyo Kabushiki Kaisha, Aichi, Japan

[21] Appl. No.: 262,797

[22] Filed: Oct. 26, 1988

[30] Foreign Application Priority Data

Oct. 30, 1987 [JP] Japan ..... 62-277011

[51] Int. Cl.[5] ..... B41J 2/295

[52] U.S. Cl. ..... 400/124; 400/56; 400/391.4; 400/398; 400/157.3; 310/311; 310/315

[58] Field of Search ..... 400/55-59, 400/124, 157.3, 166, 385-393, 398-407; 310/311, 315

[56] References Cited

U.S. PATENT DOCUMENTS

| | | | |
|---|---|---|---|
| 3,614,486 | 10/1971 | Smiley | 101/212 |
| 3,866,533 | 2/1975 | Gilbert et al. | 101/93.14 |
| 4,184,781 | 1/1980 | Ota | 400/703 |
| 4,409,509 | 10/1988 | Besocke | 310/317 |
| 4,521,786 | 6/1985 | Bain | 310/315 |
| 4,567,766 | 2/1986 | Seiferling | 310/315 |
| 4,608,506 | 8/1986 | Tanuma | 310/315 |
| 4,668,112 | 5/1987 | Gabor | 400/387 |
| 4,676,675 | 6/1987 | Suzuki et al. | 400/56 |
| 4,767,959 | 8/1988 | Sakakibara | 310/317 |
| 4,823,775 | 4/1989 | Rindt | 310/317 |
| 4,886,380 | 12/1989 | Chu | 400/121 |

FOREIGN PATENT DOCUMENTS

| | | | |
|---|---|---|---|
| 2528080 | 1/1977 | Fed. Rep. of Germany | 400/124 |
| 57767 | 4/1984 | Japan | 400/166 |
| 297155 | 12/1986 | Japan | 400/157.2 |

*Primary Examiner*—David A. Wiecking
*Assistant Examiner*—Steven S. Kelley
*Attorney, Agent, or Firm*—Oliff & Berridge

[57] ABSTRACT

A dot-matrix impact printer, including a print head including a piezoelectric element, and a print wire which is movable from a non-operated position thereof to an operated position thereof, owing to displacement of the piezoelectric element, to produce an imprint on a surface of a recording medium. The printer uses a piezoelectric control device which is responsive to a wire activation command, for applying a controlled drive voltage to the piezoelectric element to thereby activate the print wire to the operated position, wherein the drive voltage includes a static voltage which decreases with increasing paper thickness and which gets the wire close to the paper, and a dynamic voltage which provides the print force and increases with increasing paper thickness.

6 Claims, 10 Drawing Sheets

DOT-MATRIX IMPACT PRINTER USING PIEZOELECTRIC ELEMENTS FOR ACTIVATING PRINT WIRES

BACKGROUND OF THE INVENTION

1. Field of the Invention

The present invention relates to a dot-matrix impact printer having a print head wherein a print wire or wires are driven by respective piezoelectric elements.

2. Discussion of the Prior Art

To obtain a high degree of printing quality in a dot-matrix impact printer, a gap between a recording medium and a print wire in its non-operated position (hereinafter referred to as "head gap") should be held at a contant value. If the head gap is excessively large, the printing pressure of the print wires may be insufficient, causing deterioration of the printing quality such as insufficiently colored imprints or partial or complete printing failure. If the head gap is relatively small, on the other hand, the printing pressure may be excessive, causing rapid wear of the print wire, and damage of the recording medium, an ink ribbon or other members.

In the light of the above inconveniences, the known impact printers are equipped with either a mechanism for moving or positioning the print head or a carriage supporting the print head, toward and away from the recording medium, or a mechanism for moving or positioning the recording medium toward or away from the print head. This arrangement allows the head gap to be kept at a constant value, irrespective of a change in the thickness of the recording medium.

Some dot-matrix impact printers use a print head which incorporates a piezoelectric element whose displacement upon application of a voltage thereto is utilized to drive the print wire, through a suitable amplifying mechanism for amplifying the amount of displacement of the piezoelectric element.

It is noted that a piezoelectric element has a linear negative coefficient of expansion due to a variation in its temperature, namely, the amount of expansion of a piezoelectric element in the direction of its displacement linearly proportionally increases with a decrease in its temperature. It is further noted that the amount of displacement of the piezoelectric element produced by a predetermined voltage applied thereto is constant, irrespective of the temperature of the element. Therefore, even with a constant operating stroke of a print wire between the non-operated (retracted) and operated (fully advanced) positions, these two positions are changed depending upon the ambient temperature of the print head. Accordingly, the head gap and consequently the printing pressure of the print wires are changed with the ambient temperature, even when the piezoelectric elements are energized with a constant voltage. This creates a variation in the density of the printed dot maxtrix pattern, a failure to produce imprints, or other troubles which lower the printing quality of the printer.

To solve the above drawbacks, the conventional dot-matrix print head employs a temperature compensation member made of a suitable metallic or other material which has a positive coefficient of expansion due to a temperature variation. This temperature compensation member is bonded to the piezoelectric element, or incorporated in the amplifying mechanism between the piezoelectric element and the print wire, so that the temperature characteristic of the piezoelectric element is compensated for by the temperature compensation member.

However, the above-indicated positioning mechanism for moving the print head, carriage or recording medium to maintain the constant head gap makes the printer to be complicated in construction, and large-sized and expensive.

It is also noted that the temperature of the piezoelectric elements is influenced not only by the ambient temperature, but also by the heat due to resistance losses of the piezoelectric element per se and the driver circuit, and the heat due to frictional wear of the print wire. In other words, the temperature of the piezoelectric element varies depending upon its duty cycle, and therefore tends to vary frequently. Thus, the adjustment of the positioning mechanism or amplifying mechanism to keep up with the frequently varying temperature is difficult to achieve, or the mere mechanical adjustment does not permit necessary compensation of the piezoelectric element for expansion or contraction due to the temperature variation.

SUMMARY OF THE INVENTION

The present invention was developed to solve the problems encountered in the prior art, as described above. It is therefore a first object of the present invention to provide an inexpensive dot-matrix impact printer which uses a piezoelectric element for driving a print wire and which is capable of automatically establishing an optimum head gap to maintain an optimum printing pressure of the print wires for high degree of printing quality, without using an exclusive mechanism such as the positioning mechanism employed in the prior art, and based on the fact that the amount of displacement of the piezoelectric element proportionally increases with the voltage applied to the piezoelectric element.

It is a second object of the present invention to provide such a dot-matrix impact printer which establishes the optimum head gap by automatically compensating the amount of displacement of the piezoelectric element for a change in the thickness of the recording medium.

It is a third object of the invention to provide such a dot-matrix impact printer which establishes the optimum head gap by automatically compensating the amount of displacement of the piezoelectric element for expansion and contraction thereof due to a change in the temperature thereof.

The first object may be achieved according to the principle of the present invention, which provides a dot-matrix impact printer, comprising a print head including a piezoelectric element, and a print wire, and a piezoelectric control device. The print wire is movable from a non-operated position thereof to an operated position thereof, owing to displacement of the piezoelectric element, to produce an imprint on a surface of a recording medium. The piezoelectric control device operates in response to a wire activation command, for applying a controlled drive voltage to the piezoelectric element to thereby activate the print wire to the operated position, such that the drive voltage increases with an increase in a head gap which is equal to a distance between the non-operated position of the print wire and the surface of the recording medium.

In the dot-matrix impact printer of the present invention constructed as described above, the piezoelectric control device applies a controlled drive voltage to the piezoelectric element upon generation of a wire activation command. The drive voltage is controlled such that the drive voltage increases as the head gap between the non-operated position of the print wire and the surface of the recording medium is increased. Consequently, the amount of displacement of the print wire upon energization of the piezoelectric element by the controlled drive voltage is varied with a variation in the head gap which occurs due to changes in the thickness of the recording medium and in the temperature of the piezoelectric element, and for other reasons. Therefore, the instant arrangement of the piezoelectric control device assures a substantially constant printing pressure between the print wire and the recording medium, thereby providing improved printing quality, without using a conventionally used mechanism for positioning the print head or recording medium relative to each other to adjust the head gap. The elimination of the conventionally used positioning mechanism is conductive to reduction in the cost of manufacture of the printer.

The second object may be attained according to one form of the invention, wherein the piezoelectric control device comprises thickness sensing means for detecting a thickness of the recording medium, and a voltage control device for increasing the drive voltage with a decrease in the thickness of the medium detected by the thickness sensing means. In this case, the amount of change in the head gap which arises from a change in the thickness of the individual recording media may be compensated for by the voltage control device which is adapted to increase the drive voltage of the piezoelectric element with a decrease in the thickness of the recording medium, and thereby change the amount of displacement of the piezoelectric element or the print wire. The voltage control device therefore assures a constant printing pressure irrespective of a change in the thickness of the media from one medium to another.

In the above form of the invention, the piezoelectric control device may be adapted to update the drive voltage according to the detected thickness of the recording medium, in response to trigger data indicative of a condition in which the thickness of the recording medium may be changed. The piezoelectric control device thereafter maintains the updated drive voltage. For example, the initiation of a printing operation indicates the possibility of the loading of a new recording medium whose thickness may be different from the recording medium on which the last printing operating was effected. In other words, a print start command which commands the initiation of a printing operation serves as the trigger data which causes the piezoelectric control device to update the drive voltage, based on the detected thickness of the newly loaded recording medium.

The third object of the invention described above may be accomplished according to another form of the invention, wherein the piezoelectric control device comprises temperature sensing means for detecting a temperature of the piezoelectric element, and voltage control device for increasing the drive voltage with an increase in the temperature detected by the temperature sensing means. In this case, the amount of change in the head gap which arises from a variation in the temperature of the piezoelectric element is compensated for by the voltage control device which is adapted to increase the drive voltage of the piezoelectric element with an increase in the detected temperature of the same element, and thereby change the amount of displacement of the piezoelectric element or print wire. Therefore, the voltage control device assures a constant printing pressure irrespective of the temperature variation of the piezoelectric element. The piezoelectric control device may be adapted to update the drive voltage according to the detected temperature of the piezoelectric element, each time a predetermined number of lines have been printed. The piezoelectric control device thereafter maintains the updated drive voltage, until the predetermined number of lines have been printed again.

In a further form of the invention, the piezoelectric control device comprises a DC power source connected in series to the piezoelectric element, and switching means operable between a first position for inhibiting the piezoelectric element from being charged, and a second position for permitting the piezoelectric element to be charged. The switching means is normally placed in the first position, and operated to the second position upon generation of the wire activation command. The switching means is returned from the second position to the first position after a voltage across the piezoelectric element is raised to the drive voltage determined based on the head gap.

In a still further form of the invention, the piezoelectric control device comprises a DC power source connected in series to the piezoelectric element, and voltage control means for controlling a voltage across the piezoelectric element. The voltage control means includes a coil, and is operable between a charging position a discharging position. In the charging position, an electric energy of the DC power source is stored in the coil with the DC power source and the piezoelectric element being disconnected from each other, and then the electric energy stored in the coil is supplied to the piezoelectric element, whereby the piezoelectric energy is charged. In a discharging position, the electric energy of the piezoelectric element is stored in the coil with the DC power source and the piezoelectric element being disconnected from each other, and then the electric energy stored in the coil is returned to the DC power source whereby the piezoelectric energy is discharged.

In a yet further form of the invention, the piezoelectric control device controls the drive voltage such that the controlled drive voltage consists of a sum of a static voltage and a dynamic voltage which are applied to the piezoelectric element upon generation of the wire activation command. The static voltage increases with the increase in the head gap, but the static voltage does not cause the print wire to contact the surface of the recording medium. The print wire is impacted against the surface of the recording medium by a force or pressure corresponding to the dynamic voltage added to the static voltage.

In the above form of the invention, the static drive voltage determined according to the head gap is applied to the piezoelectric element before the print wire effects printing on the recording medium. In other words, the static drive voltage causes a displacement of the piezoelectric element necessary for compensation for a variation in the head gap, and does not cause the print wire to contact the surface of the medium. When the dynamic drive voltage is additionally applied to the piezoelectric element, the print wire is further moved from the position corresponding to the static drive voltage, to the operated position corresponding to the sum of the static and dynamic drive voltages. Consequently, the print wire is impacted against the medium by the pressure or force which is determined by the amount of displacement of the piezoelectric element produced by the additional application of the dynamic drive voltage. Thus, the present form of the invention is adapted to effect an impacting operation of the print wire in two steps with the static and dynamic drive voltages applied to the piezoelectric element, so as to assure a constant printing pressure of the print wire at the operated position, irrespective of a variation of the head gap. That is, the head gap after the static drive voltage is applied and before the dynamic voltage is applied is made constant by the application of the static drive voltage.

According to the above form of the invention, the magnitude of the dynamic drive voltage is a predetermined constant value corresponding to the desired amount of head gap. Therefore, even if the initial head gap amount prior to the application of the static drive voltage is varied due to a change in the thickness of the recording medium and/or a change in the temperature of the piezoelectric element, the print wire is impacted against the medium surafce with a constant pressure, whereby the printing is achieved with a comparatively high degree of imprint quality, without damage to the recording medium and/or a printing failure, even where the thickness of the recording media is varied over a relatively wide range.

Since the optimum printing pressure increases with an increase in the thickness of the recording medium, it is preferred to increase the dynamic voltage with the thickness of the recording medium.

The amount of the initial head gap may be determined based on a signal generated by a sensor for detecting the initial head gap, or based on data representative of the thickness of the recording medium, which data is entered by the operator. Alternatively, the initial head gap may be determined by using thickness sensing means for detecting the thickness of the medium. Since the initial head gap increases with a decrease in the medium thickness, the piezoelectric control device includes a static voltage control device adapted to increase the static drive voltage as the medium thickness detected by the thickness sensing means is reduced. In this case, the piezoelectric control device may be adapted to update the drive voltage according to the detected thickness of the recording medium, in response to trigger data which is indicative of a condition in which the thickness of the recording medium may be changed. The piezoelectric control device thereafter maintains the updated static voltage. For example, the trigger data consists of a print start command commanding initiation of a printing operation. In this case, the piezoelectric control device updates the static voltage, in response to the print start command.

Further, the amount of the initial head gap may be determined based on a signal generated by temperature sensing means for detecting a temperature of the piezoelectric element. Since the initial head gap increases with an increase in the temperature of the piezoelectric element, the piezoelectric control device includes a static voltage control device for increasing the static voltage with the temperature detected by the temperature sensing means. In this case, the piezoelectric control device may be adapted to update the static voltage according to the detected temperature of the piezoelectric element, each time a predetermined number of lines have been printed. The piezoelectric control device thereafter maintains the updated static voltage.

The piezoelectric control device may comprise a first drive control device, a second drive control device, and a source voltage regulating device. The first drive control device includes a first DC power source of a variable voltage type which is connected in series to the piezoelectric element and is operable to apply to the piezoelectric element a voltage equal to a voltage across the first DC power source. The second drive control device includes (a) a second DC power source of a variable voltage type connected in series to the piezoelectric element, (b) a coil connected in series to the second DC power source and the piezoelectric element, and oscillatable with the piezoelectric element at a predetermined frequency, (c) charging control means operable between a first position for inhibiting the piezoelectric element from being charged, and a second position for permitting the piezoelectric element to be charged, the charging control means being normally placed in the first position, and being operated to the second position upon generation of the wire activation command, and (d) voltage limiting means for inhibiting the piezoelectric element from being charged with an excessive electric energy from the second DC power source. The excessive electric energy causes the voltage across the piezoelectric element to exceed a predetermined upper limit which is higher than a voltage of the second DC power source. The first drive control device and the second drive control device are selectively operated. The source voltage regulating device is adapted to control the voltage of the first DC power source to the static voltage, and control the voltage of the second DC power source to coincide with the sum of the static and dynamic voltages.

The dot-matrix impact printer constructed according to the present invention may effect printing on a pressure-sensitive recording medium such that imprints are produced by means of a pressure exerted to the medium surface by the print wires, or on an ordinary recording medium such that the imprints are produced by an ink material transferred from an ink ribbon to the medium surface by impacting actions of the print wires.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which.

DETAILED DESCRIPTION OF THE PREFERRED EMBODIMENTS

Figure 1:
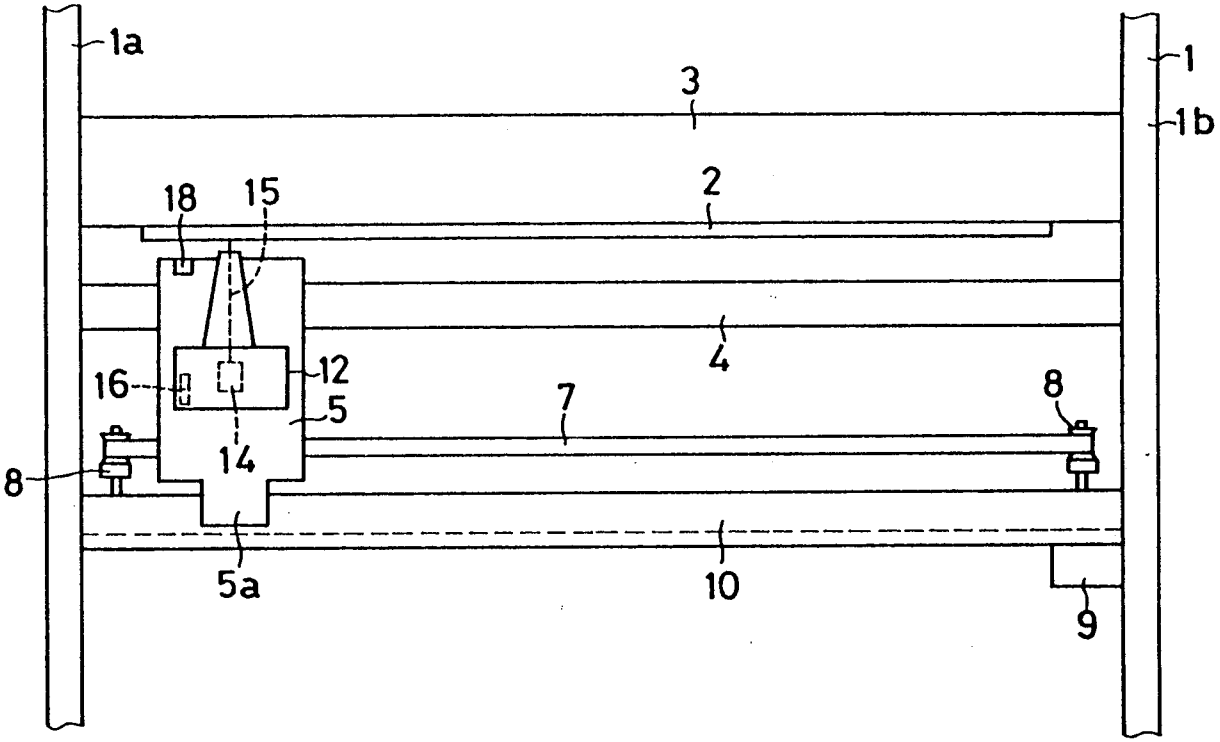
FIG. 1 is a plan view of a printing section of one embodiment of a dot-matrix printer of the present invention.
Figure 2:
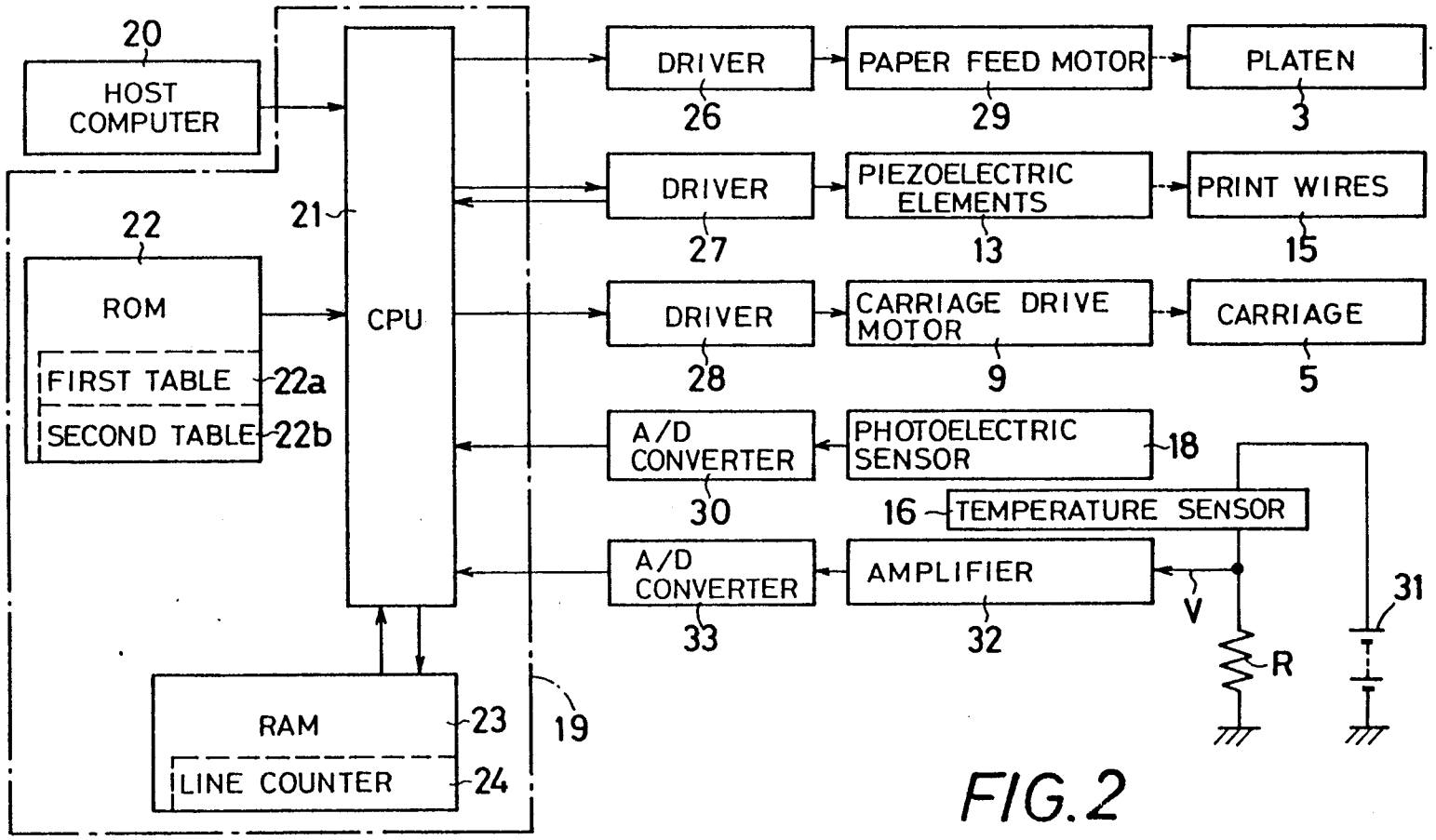
FIG. 2 is a block diagram of a control system of the printer.
Figure 3:
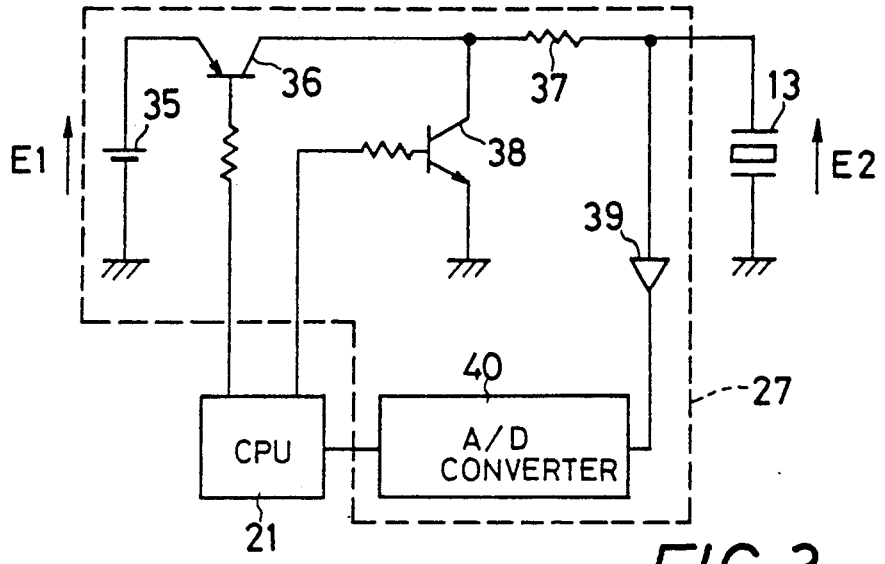
FIG. 3 is an electric circuit diagram of a driver for energizing a piezoelectric element for activating a print wire.

Referring to FIGS. 1-3, there is shown the dot-matrix printer according to the first presently preferred embodiment of the invention, wherein a platen 3 for supporting a recording medium in the form of a sheet of paper 2 is rotatably supported by and between a left and a right side wall 1*a*, 1*b* of a frame structure 1. To portions of the side walls la, 1*b* in front of the platen 3, a guide rod 4 is fixed which extends parallel to the platen 3. A carriage 5 is mounted on the guide rod 4 such that the carriage 5 is slidable along the platen 3. An endless timing belt 7 is fastened at a portion thereof to the underside of the carriage 5. The timing belt 7 spans a pair of pulleys 8, 8 such that the loop of the timing belt 7 is rotatable with the pulleys 8, to move the carriage 5 along the platen 3. One of the two pulleys 8 is connected to a drive source in the form of a carriage drive motor 9. The carriage 5 is formed with a front extension 5*a* which extends from its front portion. This front extension 5*a* slidably engages a guide rail 10 which is supported by the frame 1 so as to extend parallel to the platen 3. Thus, the carraige 5 is movable along the platen 3, while being slidably guided and supported by the guide rod 4 and the guide rail 10.

The carriage 5 has a print head 12 mounted thereon. The print head 12 includes a drive portion 14 and a plurality of print wires 15 driven by the drive portion 14. The drive portion 14 incorporates a plurality of piezoelectric elements 13 and an amplifying mechanism for amplifying amounts of displacements of the piezoelectric elements 13. Namely, the displacements of the piezoelectric elements 13 are imparted to the corresponding print wires 15 through the amplifying mechanism. Also incorporated within the print head 12 is a temperature sensor 16 for detecting the temperature of the assembly of the piezoelectric elements 13. The carriage 5 further has a photoelectric thickness sensor 18 fixed to its rear end facing the platen 3. The photoelectric sensor 18 has a light-emitting element and a light-sensitive element, which are adapted to measure the thickness of the paper sheet 2 supported by the platen 3 without contacting the sheet 2. The light-sensitive element generates a SHEET THICKNESS signal indicative of the sheet 2, as is well known in the art.

Referring next to the block diagram of FIG. 2, the control system of the instant printer uses a control device generally indicated at 19. The control device 19 includes a central processing unit (hereinafter referred to as "CPU") 21, to which are connected a ROM (read-only memory) 22 storing control programs for controlling a printing operation of the printer, and a RAM (random-access memory) 23 adapted to temporarily store printing data and control data and other, ,information received from a host computer 20. The ROM 22 incorporates a first table 22*a* which stores a relationship between the thickness of the paper sheet 2 and a commanded drive voltage Es to be applied to the piezoelectric elements 12. The ROM 22 further incorporates a second table 22*b* which stores a relationship between the temperature of the piezoelectric elements 13 detected by the temperature sensor 16, and a compensation value of the commanded drive voltage Es. The relationship stored in the second table 22*b* is used to compensate the drive voltage Es for a variation in the detected temperature of the elements 13. The above two relationships are determined such that the drive voltage Es increases with a decrease in the detected thickness of the sheet 2, and the compensation value increases with an increase in the detected temperature of the piezoelectric elements 13. The RAM 23 includes a line counter 24 for storing data indicative of the position of the paper sheet 2 in the direction of feed perpendicular to the direction of movement of the carriage 5.

To the CPU 21, there are also connected drivers 26, 27 and 28 which are connected to a paper feed motor 29, the piezoelectric elements 13, and the carriage drive motor 9, respectively. The paper feed motor 29 is adapted to rotate the platen 3 and thereby feed and advance the paper sheet 2, and the carriage drive motor 9 is adapted to rotate the pulleys 8 to move the carriage 5 via the timing belt 7. The piezoelectric elements 13 are adapted to impact the corresponding print wires 15, to produce imprints in the form of a dot matrix on the surface of the sheet 2, upon generation of appropriate wire activation commands of the printing data.

The photoelectric thickness sensor 18 is also connected to the CPU 21 via an A/D converter 30, so that the SHEET THICKNESS signal indicative of the thickness of the sheet 2 is applied to the CPU 21. A series circuit consisting of the temperature sensor 16 and a resistor R is connected to a DC power source 31. A terminal voltage V of the resistor R is amplified by an amplifier 32, and the amplified voltage V is converted by an A/D converter 33 into a TEMPERATURE signal, which is also applied to the CPU 21.

On the other hand, the driver 27 consists of an electric circuit as illustrated in FIG. 3, for example. In this circuit, a DC power source 35 is connected to one of opposite terminals of each piezoelectric element 13, via a first transistor 36 and a resistor 37. To a collector terminal of the first transistor 36 is connected a second transistor 38, whose emitter terminal is grounded. The base terminal of each of the first and second transistors 36, 38 is connected to the CPU 21. The above-indicated one terminal of the piezoelectric element 13 is connected to the CPU 21 through an amplifier 39 and an A/D converter 40, whereby a terminal voltage E2 of the piezoelectric element 13 which is converted into a digital signal by the converter 40 is applied to the CPU 21. The other terminal of the piezoelectric element 13 is grounded.

Figure 4:
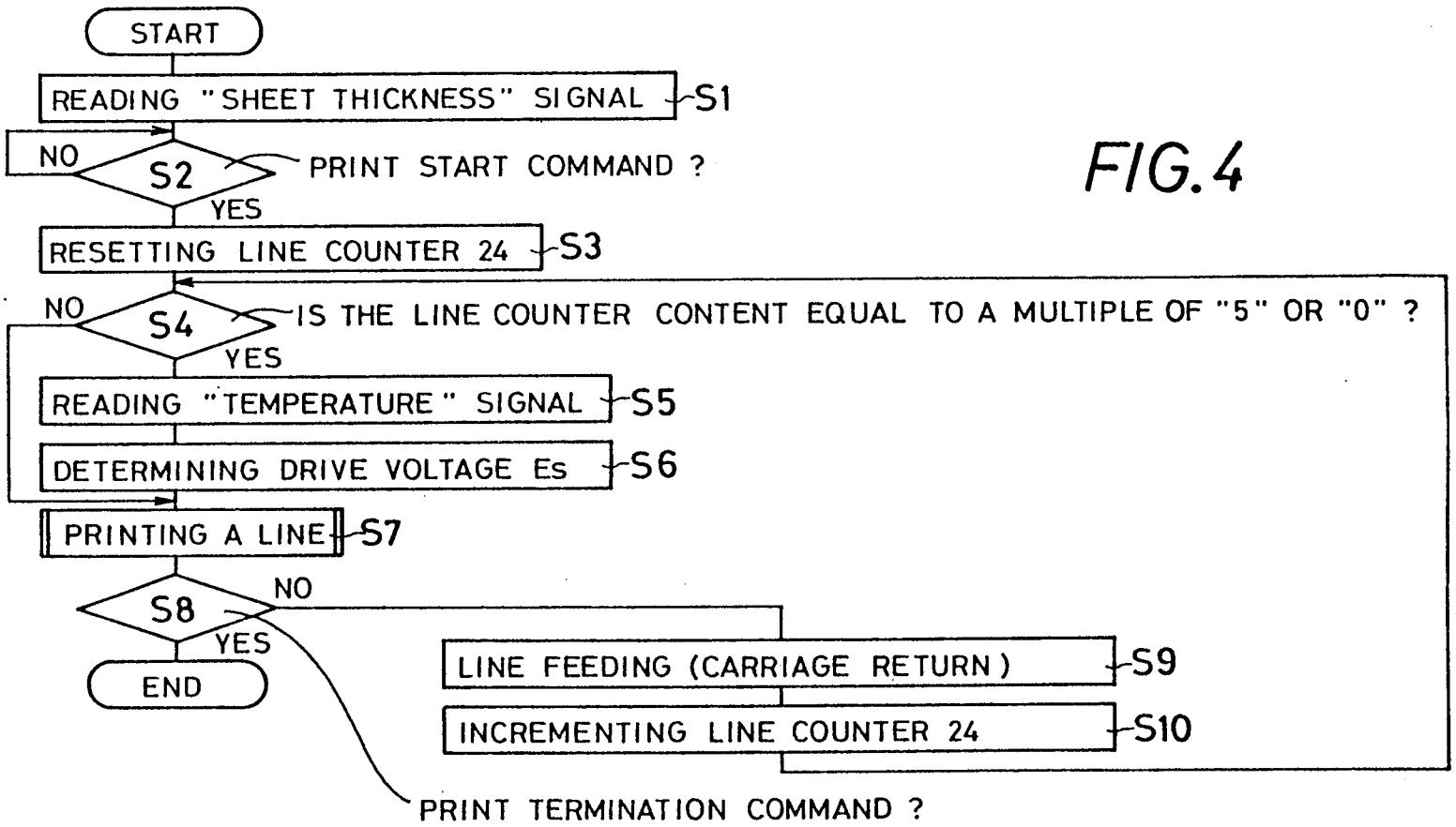
FIGS. 4 and 5 are flow charts showing an operation of a CPU of the control system.

Referring next to the flow charts of FIGS. 4 and 5, an operation of the printer constructed as described above will be described.

When the CPU 21 receives a paper feed command from the host computer 20 or from a PAPER FEED key provided on the printer, the CPU 21 commands the driver 26 to activate the paper feed motor 29, whereby the platen 3 is rotated to feed the paper sheet 2 to a predetermined printing start postion. At the end of this paper loading operation, the CPU 21 executes a routine according to the flow chart of FIG. 4.

Initially, the CPU 21 executes step S1 to read the SHEET THICKNESS signal received from the piezoelectric thickness sensor 18 through the A/D converter 30, and stores in the RAM 23 SHEET THICKNESS DATA representative of the thickness of the sheet 2 detected by the sensor 18. The control flow then goes to step S2 to determine whether the CPU 21 has received a PRINT START command from the host computer 20. This step S2 is repeatedly implemented until the PRINT START command is generated. Upon generation of the PRINT START command, the CPU 21 executes next step S3 wherein the line counter 24 is reset to zero ("0"). Then, the control flow goes to step S4 wherein the CPU 21 determines whether the content of the line counter 24 is equal to a multiple of "5" or "0". When step S4 is executed for the first time after the generation of the PRINT START command, an affirmative decision (YES) is obtained in step S4. If the content of the line counter 24 is a multiple of "5" or "0", an affirmative decision (YES) is obtained in step S4, and the control flow goes to step S5 wherein the CPU 21 reads out the TEMPERATURE signal of the temperature sensor 16 received from the A/D converter 33, which indicates the temperature of the piezoelectric elements 13. The TEMPERATURE signal is stored in the RAM 23. In the next step S6, the CPU 21 determines the drive voltage Esl, based on the detected thickness of the paper sheet 2 stored in the RAM 23, and according to the relationship stored in the first table 22*a* of the ROM 22. Further, the CPU 21 determines a compensation value of the dive voltage Esl, based on the detected temperature of the piezoelectric elements 13 stored in the RAM 23, and according to the relationship stored in the second table 22*b* of the ROM 22. That is, the CPU 21 updates the drive voltage Esl determined by the thickness of the sheet 2, depending upon the detected temperature of the elements 13. The updated or compensated drive voltage Es is stored in the RAM 23. The control flow then goes to step S7 to effect printing of a line according to the received printing data (wire activation commands) for the line. In this printing operation, the CPU 21 controls the driver 27 such that a voltage actually applied to the appropriate piezoelectric elements 13 coincides with the finally determined or updated drive voltage Es stored in the RAM 23.

Figure 5:
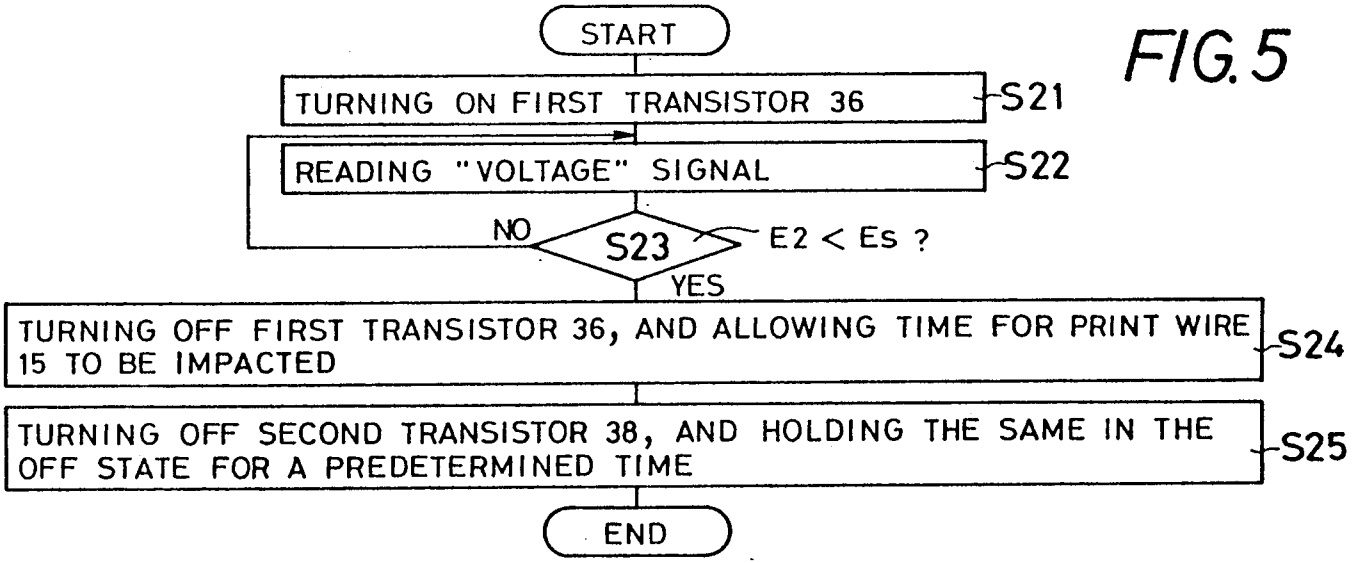

In step S7, the driver 27 is controlled according to the flow chart of FIG. 5. Initially, the control flow goes to step S21 in which the CPU 21 turns on the first transistor 36, so that the piezoelectric element 13 is charged with the electric energy of the DC power source 35 supplied through the resistor 37. Accordingly, the piezoelectric element 13 is displaced by an appropriate amount. At this time, the terminal voltage E2 of the piezoelectric element 13 increases at a rate corresponding to a time constant CR which is determined by the resistance R of the resistor 37 and the capacity C of the piezoelectric element 13. In the next step S22, the CPU 21 receives a VOLTAGE signal from the A/D converter 40 which corresponds to the actual terminal voltage E2 of the piezoelectric element 13. The control flow then goes to step S23 to determine whether the actual terminal voltage E2 determined in step S22 is smaller than the commanded drive voltage Es stored in the RAM 23, or not. A negative decision (NO) is obtained in step S23 until the terminal voltage E2 is raised to the commanded drive voltage Es. Namely, steps S22 and S23 are repeatedly executed until an affirmative decision (YES) is obtained in step S23, i.e., until the terminal voltage E2 is raised to the drive voltage Es. When the affirmative decision (YES) is obtained in step S23, the CPU 21 implements step S24 to turn off the first transistor 36 to stop charging the piezoelectric element 13 with the electric energy from the DC power source 35, and hold the first transistor 36 in its off state for a predetermined time necessary to permit a sufficient impacting motion of the print wire 15 by the displacement of the piezoelectric element 13. Then, step S25 is executed to turn off the second transistor 38 and hold the same transistor 38 in its off state for a predetermined time, in order to permit the piezoelectric element 13 to be discharged, whereby the displaced piezoelectric element 13 is restored to its original non-displaced position. With this step S25 completed, the CPU 21 terminates the regulation of the driver 27.

After the printing of the above-indicated one line in step S7 is completed, the CPU 21 performs step S8 to determine whether a PRINT TERMINATION command has been received from the host computer 20, or not. Upon generation of the PRINT TERMINATION command, the CPU 21 ends the printing operation according to the flow chart of FIG. 4, with an operation to activate the paper feed motor 29 to rotate the platen 3 for ejecting the printed sheet 2 from the printer. If the PRINT TERMINATION command has not been received, and a LINE FEEDING or CARRIAGE RETURN command is present, step S8 is followed by step S9 wherein the CPU 21 activates the paper feed motor 29 by a predetermined amount to rotate the platen 3, for advancing the sheet 2 to the next printing line. Then, the CPU 21 executes step S10 to increment the content of the line counter 24, and returns to step S4.

If the CPU 21 determines in step S4 that the count of the line counter 24 is not equal to a multiple of "5" or "0", a negative decision (NO) is obtained, and the control flow goes to step S7, skipping steps S5 and S6.

It will be understood from the foregoing description of the instant printer that the thickness of the paper sheet 2 is detected when the printer is loaded with the sheet 2, more precisely when the print start command is generated. Further, the temperature of the piezoelectric elements 13 is detected each time five lines have been printed on the sheet 2. Based on the detected thickness of the sheet 2 and the detected temperature of the piezoelectric elements 13, the drive voltage Es is determined as a reference value to which the voltage applied to the piezoelectric elements is controlled. The thus determined drive voltage Es is used until the drive voltage Es is again determined or updated. The PRINT START command and the output of the line counter 24 when its content is equal to a multiple of "5" serve as trigger data for updating the drive voltage Es. In the instant embodiment, therefore, the amount of displacement of the piezoelectric elements 13 is controlled depending upon the specific thickness of the sheet 2 and the varying temperature of the piezoelectric elements 13, whereby the pressure of impact of the print wires 15 against the sheet 2 can be held constant to assure high quality of the produced imprints, even if the thickness of the sheet 2 is changed or the elements 13 expand and contract due to a variation in the temperature.

Figure 6:
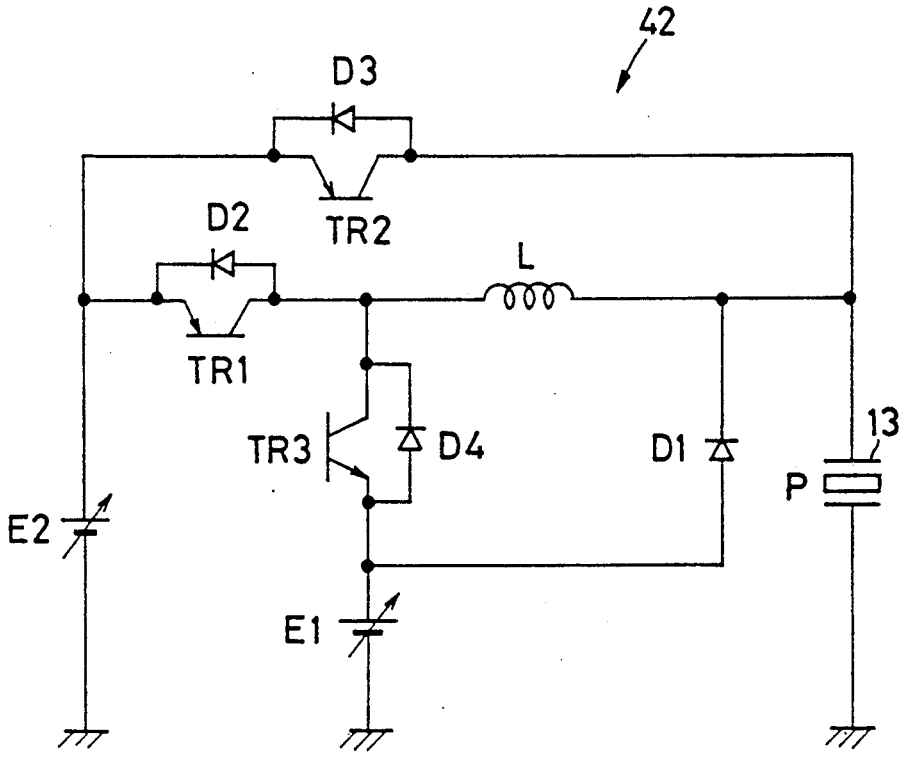
FIG. 6 is an electric circuit diagram of a driver for energizing a piezoelectric element used in another embodiment.
Figure 7:
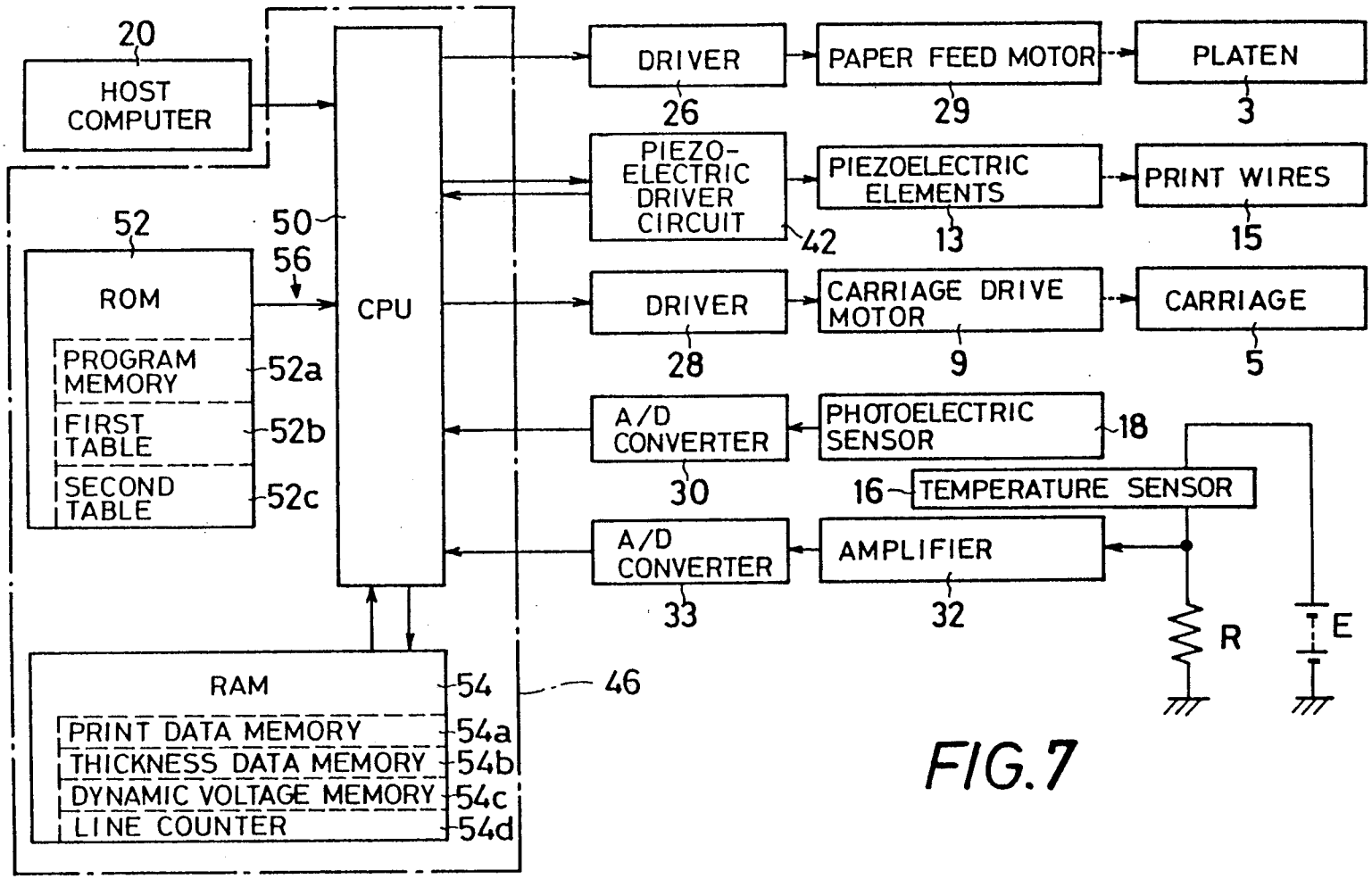
FIG. 7 is a block diagram of a control system of the embodiment of FIG. 6, corresponding to FIG. 2.

Referring next to FIGS. 6 and 7, another embodiment of the dot-matrix impact printer of the invention will be described. In the interest of simplification, the same reference numerals as used in FIG. 2 will be used to identify the same components, and only those components of FIG. 7 different from the corresponding components of FIG. 2 or not provided in the embodiment of FIG. 2 will be described.

In the instant second embodiment, each piezoelectric element 13 is driven by a piezoelectric drive circuit generally indicated at 42 in FIG. 6. In this drive circuit 42, a first DC power source E1 of a variable voltage type, a diode D1 and the piezoelectric element 13 are connected in series, and the negative terminals of the first DC power source E1 and piezoelectric element 13 are grounded. The diode D1 permits an electric current flow in a direction from the positive terminal of the first DC power source E1 to the positive terminal of the piezoelectric element 13.

A series circuit consisting of a second DC power source E2 of a variable voltage type, a transitor TR1 and a coil L is connected in parallel to the first DC power source E1 and the diode D1. The transistor TR1 permits an electric current flow in a direction from the positive terminal of the second DC power source E2 to the positive terminal of the piezoelectric element 13. The transistor TR1 is bypassed by a diode D2 which permits an electric current flow in the opposite direction from the positive terminal of the piezoelectric element 13 to the positive terminal of the second DC power source E2. The transistor TR1 and the coil L are bypassed by a transistor TR2 which permits an electric current flow in the same direction as the transistor TR1. The transistor TR2 is bypassed by a diode D3 which permits an electric current flow in the opposite direction.

A transistor TR3 is connected between the positive terminal of the first DC power source E1, and the end of the coil L corresponding to the positive terminal of the second DC power source E2. The transistor TR3 permits an electric current flow in a direction from the above-identified end of the coil L to the positive terminal of the first DC power source E1. The transistor TR3 is bypassed by a diode D4, which permits an electric current flow in the direction opposite to that of the transistor TR3.

The instant printer is controlled by a control device 46 as shown in FIG. 7, which includes a CPU 50, a ROM 52 and a RAM 54 that are interconnected by a bus 56. To the CPU 50 is connected the above-indicated piezoelectric driver circuit 42, as well as the drivers 26, 28, A/D converters 30, 33 and host computer 20 which have been described with respect to the first embodiment by reference to FIG. 2.

The CPU 50 receives from the host computer 20 the printing data, PRINT START command, PRINT TERMINATION command, and other data for controlling the printer. The ROM 52 includes (a) a program memory 52*a* storing a main control program as shown in the flow chart of FIG. 8 and a piezoelectric drive sub-routine as shown in the flow chart of FIG. 9, (*b*) a first table 52*b* storing a predetermined relationship between the thickness of the paper sheet 2 and a dynamic drive voltage Vd for the piezoelectric element 13, and (c) a second table 52*c* storing a predetermined relationship among the thickness of the sheet 2, a temperature of the piezoelectric element 13 and a static drive voltage Vs for the piezoelectric element 13. The relationships stored in the first and second tables 52*b*, 52*c* are determined such that the dynamic drive voltage Vd increases with an increase in the thickness of the paper sheet 2, while the static drive voltage Vs increases with a decrease in the thickness of the sheet 2 and with an increase in the temperature of the piezoelectric element 13.

The RAM 54 includes a PRINT DATA memory 54*a* for storing the printing data received from the host computer 20, a THICKNESS DATA memory 54*b* for storing data representative of the thickness of the sheet 2 detected by the photoelectric sensor 18, a DYNAMIC VOLTAGE memory 54*c* for storing data representative of the dynamic drive voltage Vd determined by the CPU 50, and a line counter 54*d* for storing data representative of the current line of printing as counted from the print start position.

Figure 8:
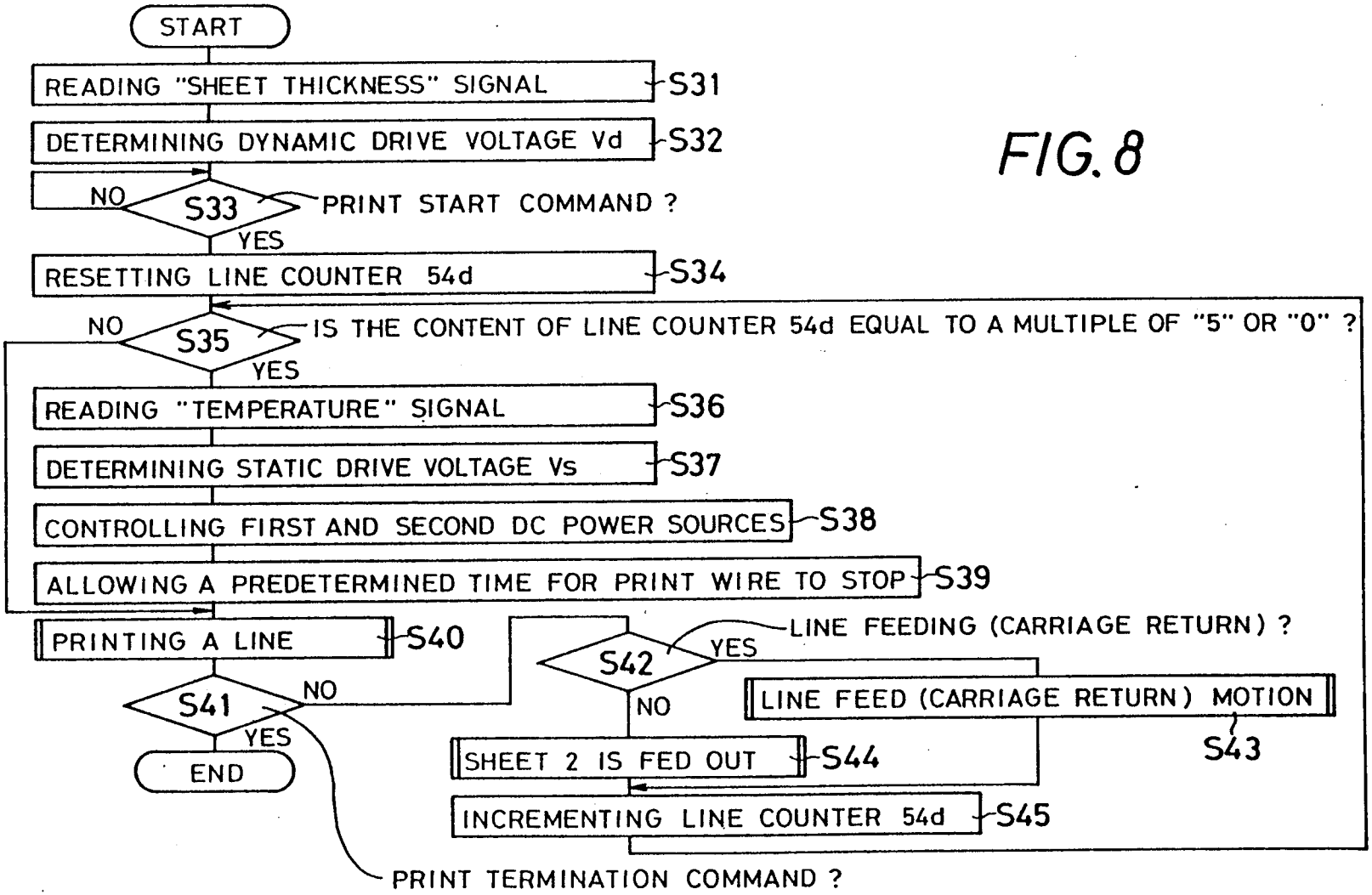
FIGS. 8 and 9 are flow charts showing an operation of a CPU of the control system of FIG. 7, corresponding to FIG. 4 and 5.

There will be described an operation of the instant printer controlled by the control system of FIG. 7, referring to FIGS. 6, 8 and 9.

When the CPU 50 receives a paper loading command from the host computer 20 or a paper loading key on the printer after the printer is turned on, the CPU 50 commands the motor driver 26 to activate the paper feed motor 29, whereby the platen 3 is rotated to feed the paper sheet 2 to the predetermined printing start position. Thus, the printer is loaded with the sheet 2. Then, the CPU 50 executes the main program as illustrated in the flow chart of FIG. 8.

Initially, the control flow goes to step S31 wherein the CPU 50 reads the SHEET THICKNESS signal from the photoelectric sensor 18 via the A/D converter 30, and stores the detected thickness of the sheet 2 in the THICKNESS DATA memory 54*b* of the RAM 54. The control flow then goes to step S32 wherein the CPU 50 determines the dynamic drive voltage Vd, based on the detected thickness of the sheet 2, and according to the relationship stored in the first table 52*b*. The determined dynamic drive voltage Vd is stored in the DYNAMIC VOLTAGE memory 54*c* of the RAM 54. Step S32 is followed by step S33 to determine whether the PRINT START command has been received from the host computer 20, or not. If the PRINT START command is present, the control flow goes to step S34 to reset the line counter 54*d* of the RAM 54.

Then, the control flow goes to step S35 to determine whether the current content of the line counter 54*d* is equal to zero ("0") or a multiple of "5". Since the line counter 54*d* has been reset to zero in the preceding step S34, an affirmative decision (YES) is obtained in step S35, and step S36 and the following steps will be implemented. In step S36, the CPU 50 reads the TEMPERATURE signal from the temperature sensor 16 via the A/D converter 33. Then, in step S37, the CPU 50 determines the static drive voltage Vs, based on the detected temperature of the piezoelectric element 13, and the previously detected thickness of the sheet 2 (stored in the THICKNESS DATA memory 54*b* of the RAM 54), and according to the predetermined relationship stored in the second table 52*c* of the ROM 52. Step S37 is followed by step S38 wherein a first voltage Ve1 of the first DC power source E1 is controlled to be equal to the determined static drive voltage Vs, while a second voltage Ve2 of the second DC power source E2 is controlled to be equal to a sum of the determined static and dynamic drive voltages Vs and Vd. In this voltage control operation, the electric energy of the first DC power source E1 is supplied via the diode D1 to the piezoelectric element 13 (each of the elements 13 corresponding to the print wires 15 which have been commanded to be activated), whereby a voltage Vp across the piezoelectric element 13 is raised almost to the level of the first voltage Ve1, and the piezoelectric element 13 and the corresponding print wire 15 are accordingly displaced. However, the amount of displacement of the print wire 15 (piezoelectric element 13) is not sufficient to enable the print wire 15 to contact the surface of the paper sheet 2. Namely, the print wire 15 does not produce a dot imprint on the sheet 2. In the next step S39, a predetermined time is allowed for the print wire 15 to be completely stopped.

The control flow then goes to step S40 wherein the printing of one line is effected according to the printing data which has been received from the host computer 20 and stored in the PRINT DATA memory 54*a*. Described more specifically, the CPU 50 determines the print wires 15 which are currently commanded to be activated at a current column of a dot-matrix pattern, based on the wire activation commands of the printing data, each time the print head 12 is moved along the line of printing by a predetermined incremental distance to the appropriate column position. The CPU 50 activates the piezoelectric elements 13 corresponding to the commanded print wires 15, through the corresponding piezoelectric driver circuits 42, according to the piezoelectric drive sub-routine illustrated in the flow chart of FIG. 9. This sub-routine will be described.

Normally, the transistors TR1, TR2 and TR3 of each piezoelectric driver circuit 42 of FIG. 6 are normally placed in the off state. Upon execution of step S40 of FIG. 8, the control flow initially goes to step S51 of the sub-routine of FIG. 9, wherein the transistor TR1 is turned on. The same transistor TR1 is held in the on state for a predetermined time in step S52. While the transistor TR1 is held on, the electric energy of the second DC power source E2 is supplied via the coil L to the piezoelectric element 13. As a result, the voltage Vp across the element 13 is raised from the level almost equal to the first voltage Ve1, to a level almost equal to the second voltage Ve2. Consequently, the tip of the print wire 15 is impacted against the paper sheet 2 via a print ribbon, whereby a dot is imprinted on the sheet 2. The printing pressure between the print wire 15 and the sheet 2 corresponds to an amount of displacement or operating stroke of the print wire 15 which is produced by an increase of the voltage Vp of the piezoelectric element 13 from the level almost equal to the first voltage Ve1 of the first DC power source E1 to the level almost equal to the second voltage Ve2 of the second DC power source E2. Therefore, the printing pressure can be held constant at an optimum level, irrespective of a variation in the head gap between the surface of the sheet 2 and the tip of the print wire 15, which may occur due to a change or variation in the thickness of the individual sheets 2, and/or a change in the temperature of the piezoelectric element 13 during the printing operation (from the beginning to the end of a page).

It is noted that the diode D1 prevents the electric energy of the piezoelectric element 13 from being released to the first DC power source E1, even if the transistor TR1 is on and the voltage Vp across the piezoelectric element 13 exceeds the first voltage Ve1. Further, the diode D3 prevents the voltage Vp from exceeding the second voltage Ve2. Even when the electric energy of the piezoelectric element 13 is consumed by an impacting movement of the print wire 15 against the sheet 2, the voltage Vp across the piezoelectric element 13 will not be lowered, since the electric energy of the second DC power source E2 is supplied to the piezoelectric element 13 via the transistor TR1 and the coil L, in order to compensate for the energy consumption by the element 13. Hence, the amount of displacement of the piezoelectric element 13 can be controlled at a constant level. The time delay provided in step S52 is determined such that step S53 is started at a point which is a suitable time after the moment when the voltage Vp becomes substantially equal to the second voltage Ve2 of the second DC power source E2.

In step S53, the transistor TR1 is restored to the off state. The transistor TR2 is then turned on in the next step S54. The transistor TR2 is held in the on state until an affirmative decision (YES) is obtained in step S55. Then, the transistor TR2 is turned off in step S56 when a predetermined time has passed after the transistor TR1 was turned on in step S51. While the transistor TR2 is on, an excessive amount of electric energy (stored in the coil L) that would cause the voltage VP of the piezoelectric element 13 to exceed the second voltage Ve2 is returned to the second DC power source E2 via the diode D3. The predetermined time used in step S55 is determined so as to expire at the time when the electric energy of the coil L is entirely returned to the second DC power source E2, or at a point shortly after that time. Even if the electric energy of the piezoelectric element 13 is consumed, the voltage Vp can be held at a level almost equal to the second voltage Ve2, because of the energy supply from the second DC power source E2 to the piezoelectric element 13 via the transistor TR2.

Step S56 is immediately followed by step S57 to turn on the transistor TR3. As a result, the electric energy of the piezoelectric element 13 is moved to the coil L, and the voltage Vp of the piezoelectric element 13 is lowered. Consequently, the amount of displacement of the element 13 is reduced, whereby the print wire 15 is restored to the non-operated position. Then, the control flow goes to step S58 to determine whether the voltage Vp has been lowered to the first voltage Ve1, namely, whether the electric energy of the piezoelectric element 13 which has been supplied from the second DC power source E2 is entirely released to the coil L. When the voltage Vp becomes equal to the first voltage Ve1, step S58 is followed by step S59 in which the transistor TR3 is turned off. Then, the control flow goes back to step S40 of the main program of FIG. 8.

After the relevant line has been printed in step S40, the control flow goes to step S41 to determine whether the PRINT TERMINATION command has been received, or not. In this first execution of step S41 wherein no PRINT TERMINATION command has been received, a negative decision (NO) is obtained in step S41, and the control flow goes to step S42 to determine whether a LINE FEED or CARRIAGE RETURN command has been received, or not. If the LINE FEED command has been received, step S42 is followed by step S43 in which the line feed or carriage return operation is effected. If not, step S42 is followed by step S44 in which the sheet 2 is fed out and the printer is loaded with a new sheet. Steps S43 and S44 are followed by step S45 in which the line counter 54*d* is incremented.

While the present embodiment is adapted such that step S44 is followed by step S45 and S35, it is possible that step S44 is followed by step S31. In this case, the dynamic drive voltage Vd is determined based on the detected thickness of the newly loaded sheet 2.

In the case where the line feed or carriage return operation is effected in step S43 to feed the sheet 2 to the second line position, a negative decision (NO) is obtained in step S35 following step S45. In this case, steps S36–S39 are skipped, and the control flow goes directly to step S40. Accordingly, the first and second voltages Ve1 and Ve2 as used for printing the first line remain unchanged. Then, step S41 and the following steps S42, S43 and S45 are executed in the same manner as practiced for the first line. When the number of the lines which have been printed is equal to a multiple of "5", an affirmative decision (YES) is obtained in step S35 prior to printing the next line, and the static drive voltage Vs is updated in step S37, based on the detected thickness of the sheet 2 and the detected temperature of the piezoelectric element 13. Then, in step S38, the first and second voltages Ve1 and Ve2 are regulated. It will be understood from the above description that the static drive voltage Vs is updated each time the printer is loaded with the new sheet 2, and each time the printing of successive five lines is completed, while the dynamic drive voltage Vd is updated only when the printer is loaded with the sheet 2. When the printing operation according to the received printing data is completed, or when the CPU 50 receives the PRINT TERMINATION command, an affirmative decision (YES) is made in step S41, and the printing operation is ended.

As is apparent from the foregoing description, the instant embodiment is provided with a piezoelectric control device which is constituted by the photoelectric thickness sensor 18, temperature sensor 16, piezoelectric driver circuit 42, and portions of the control device 46 which are assigned to determine the static and dynamic drive voltages Vs and Vd, regulate the first and second voltages Ve1 and Ve2, and control the transistors TR1, TR2 and TR3.

Figure 10:
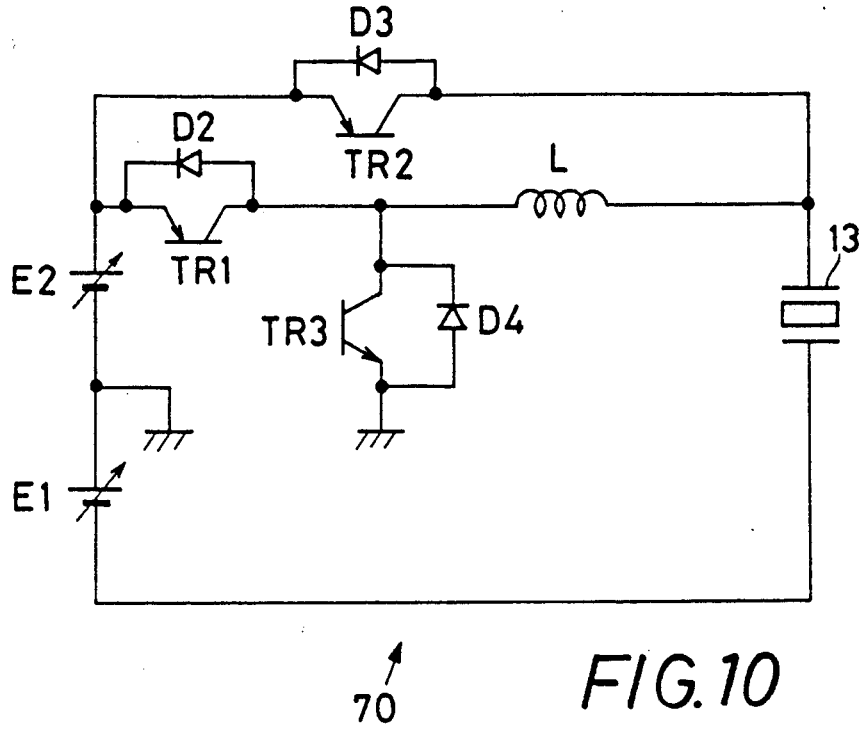
FIG. 10 is an electric circuit diagram of a piezoelectric element used in a further embodiment.

Referring to FIG. 10, another modified embodiment of the invention will be described. This embodiment uses a piezoelectric driver circuit 70 which is different from the piezoelectric driver circuit 42 of the preceding embodiment, in that the diode D1 is eliminated, and the positive terminal of the first DC power source E1 is connected to the negative terminal of the second DC power source E2 and grounded. Further, the negative terminal of the first DC power source E1 is connected to the negative terminal of the piezoelectric element 13.

An operation of the piezoelectric driver circuit 72 of the instant embodiment will be described. In the present embodiment, the first and second voltages Ve1 and Ve2 are controlled to be equal to the determined static and dynamic voltages Vs and Vd, respectively, in step S38 of the main program which has been described with respect to the preceding embodiment.

Normally, the transistors TR1, TR2, TR3 are placed in the off state. In this condition, the electric energy of the first DC power source E1 is supplied to the piezoelectric element 13 via the diode D4 and coil L, and the voltage Vp across the element 13 oscillates about a point almost equal to the first voltage Ve1. This oscillation attenuates with time, and the voltage Vp is eventually stabilized at the first voltage Ve1. Thus, the piezoelectric element 13 is displaced by an amount which moves the print wire 15 but does not cause the print wire to contact the paper sheet 2.

Figure 9:
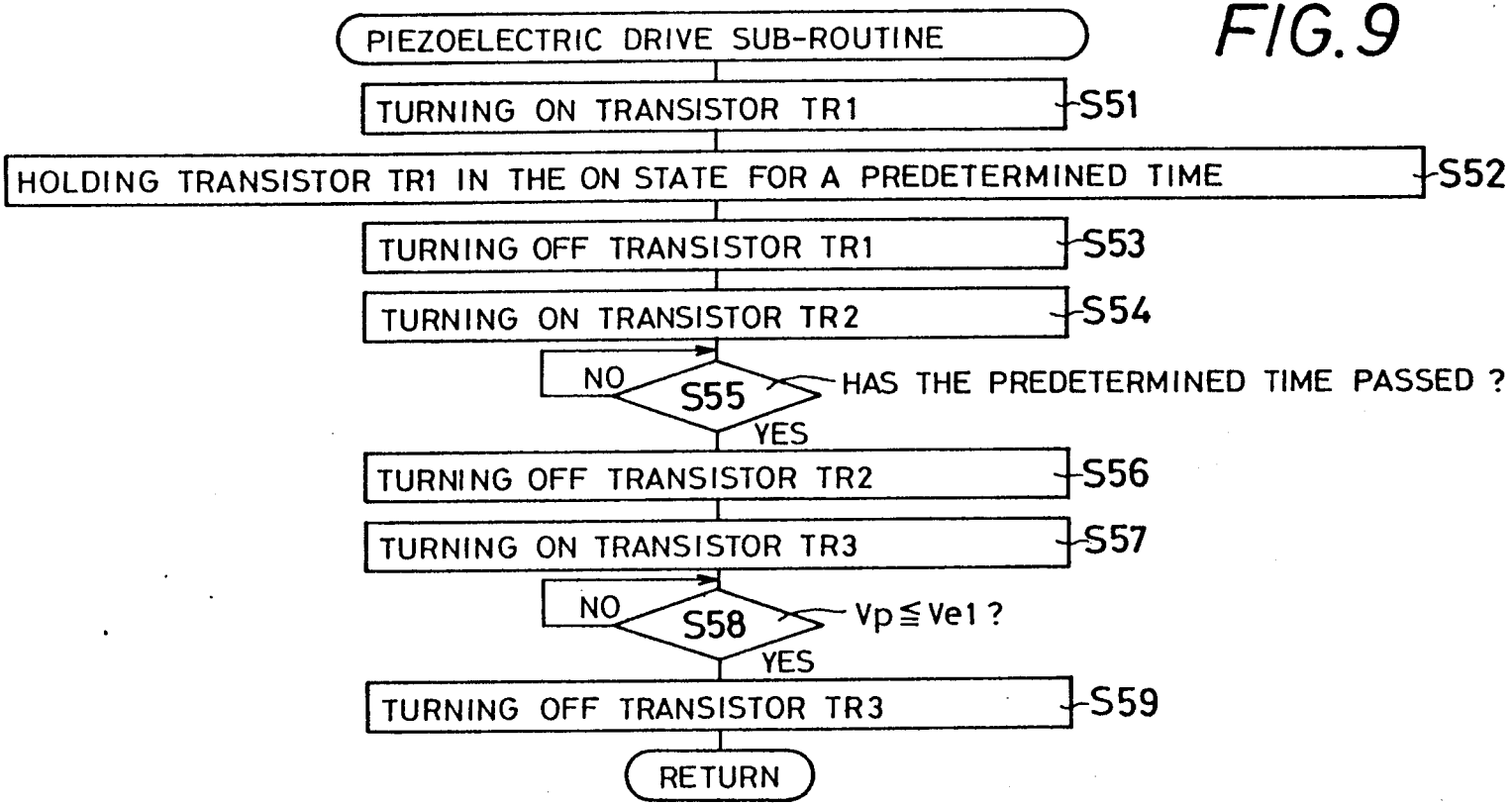

Subsequently, the piezoelectric drive sub-routine of FIG. 9 is implemented with respect to the piezoelectric driver circuit 70. When the transistor TR1 is switched from the off state to the on state, the sum of the first and second voltage Ve1 and Ve2 is applied to the series circuit of the coil L and the piezoelectric element 13, via the transistor TR1, whereby the voltage Vp of the piezoelectric element 13 is raised from a level almost equal to the first voltage Ve1, to a level almost equal to the sum of the first and second voltages Ve1 and Ve2. Thereafter, the voltage Vp is held at the raised level. Consequently, the print wire 15 is impacted against the sheet 2, to produce a dot imprint on the sheet. The following events of operation are the same as in the preceding embodiment using the piezoelectric driver circuit 42.

In the instant embodiment, the piezoelectric element 13 is energized by the sum of the first and second voltages Ve1 and Ve2 of the first and second DC power sources E1 and E2, to activate the corresponding print wire 15 for producing a dot imprint on the sheet 2. Therefore, the second voltage Ve2 may be made lower than that in the preceding embodiment. Further, the instant embodiment does not require the diode D1 and is accordingly available at a reduced cost.

It will be understood from the above description that the instant embodiment uses a piezoelectric control device which is constituted by the photoelectric sensor 18, temperature sensor 16, piezoelectric driver circuit 70, and portions of the control device 46 which are assigned to determine the static and dynamic drive voltages Vs and Vd, regulate the first and second voltages Ve1 and Ve2, and control the transistors TR1, TR2 and TR3.

Figure 11:
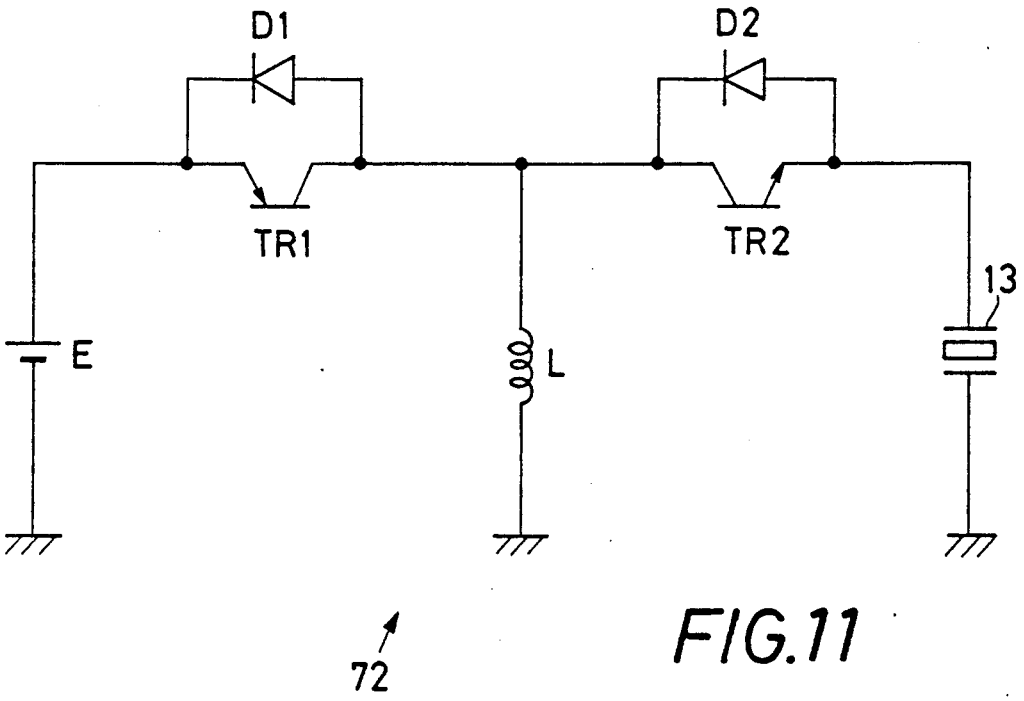
FIG. 11 is an electric circuit diagram of a piezoelectric element used in a still further embodiment.
Figure 13:
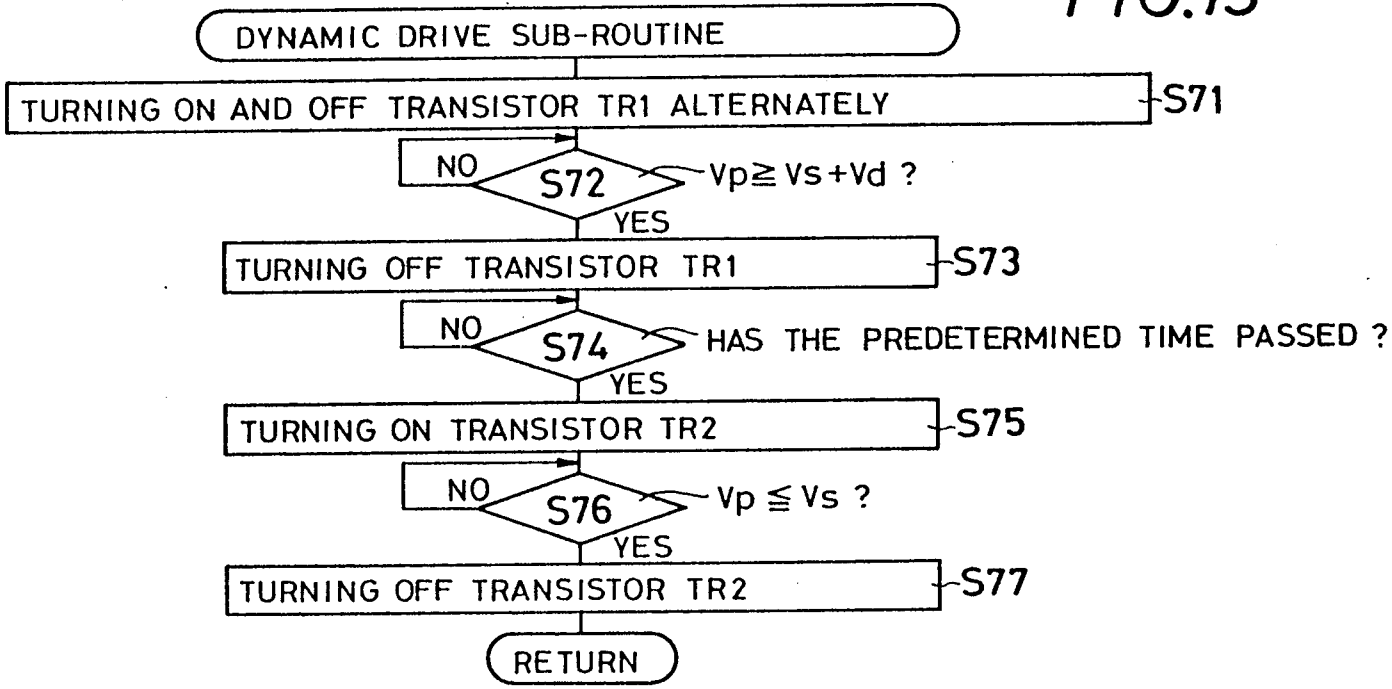

A further modified piezoelectric driver circuit 72 used in a further embodiment of the invention is illustrated in FIG. 11. In this driver circuit 72, a DC power source E capable of producing a predetermined line voltage, transistors TR1, TR2 and the piezoelectric element 13 are connected in series. The negative terminal of the DC power source E, and the terminal of the piezoelectric element 13 not connected to the transistor TR2 are both grounded. The transistors TR1 and TR2 permit an electric current flow in a direction from the positive terminal of the DC power source E to the terminal of the element 13 connected to the transistor TR2. The transistors TR1, TR2 are bypassed with respective diodes D1 and D2, which permit an electric current flow in the direction opposite to the direction of current flow through the transitors TR1, TR2. A connection between the two transistors TR1, TR2 is connected to a coil L.

Figure 12:
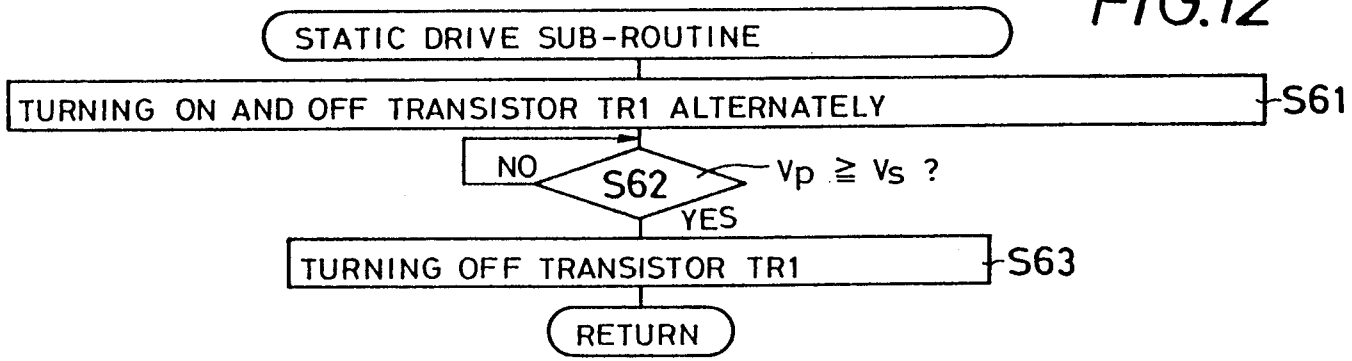
FIGS. 12 and 13 are flow charts of a static drive sub-routine and a dynamic drive sub-routine, respectively, for energizing the piezoelectric element of FIG. 11.

In the present embodiment of FIG. 11, a static drive sub-routine of FIG. 12 is implemented. In this sub-routine, step S61 is initially executed to turn on and off the transistor TR1 alternately at a predetermined relatively high frequency. With the transistor TR1 placed in the on state, the electric energy of the DC power source E is stored in the coil L via the transistor TR1. With the transistor TR1 placed in the off state, the coil L, piezoelectric element 13 and the diode D2 form a current flow loop, whereby the electric energy of the coil L is stored in the piezoelectric element 13. As a result of this alternate on/off operation of the transistor TR1, the voltage Vp across the element 13 begins to be elevated. When the voltage Vp almost reaches the static voltage Vs, an affirmative decision (YES) is obtained in step S62, and step S63 is implemented to hold the transistor TR1 in the off state, and hold the voltage Vp of the element 13 at a substantially constant level In the present embodiment of FIG. 11, a dynamic drive sub-routine as illustrated in the flow chart of FIG. 12 is executed in place of the piezoelectric drive sub-routine of FIG. 9. Described more particularly, step S71 is implemented to turn on and off the transistor TR1 alternately, to raise the voltage Vp from a level almost equal to the static voltage Vs, until the voltage Vp reaches a level almost equal to the sum of the static and dynamic drive voltages Vs and Vd, namely, until an affirmative decision (YES) is obtained in step S72.

Then, the control flow goes to step S73 to turn off the transistor TR1, whereby the voltage Vp is held at a substantially constant level. At this time, a dot imprint is produced on the sheet 2.

Then, step S74 is implemented to determine whether a predetermined time has passed after the execution of step S71. If so, step S74 is followed by step S75 wherein the transistor TR2 is switched to the on state. As a result, the piezoelectric element 13 is discharged, with its electric energy being released to the coil L. When the voltage Vp across the piezoelectric element 13 is lowered down to the static voltage Vs, an affirmative decision (YES) is obtained in step S76, and the control flow goes to step S77 to restore the transistor TR2 to its off state. Consequently, the electric energy of the coil L is returned to the DC power source E via the diode D1.

It will be understood from the above description that the present embodiment uses a piezoelectric control device which is constituted by the photoelectric sensor 18, temperature sensor 16, piezoelectric driver circuit 72, and portions of the control device 46 which are assigned to determine the static and dynamic voltages Vs and Vd, and control the transistors TR1, TR2.

While the present invention has been described in its presently preferred embodiments, it is to be understood that the invention is not limited to the precise details of the illustrated embodiments, but may be embodied with various changes, modifications and improvements, which may occur to those skilled in the art, without departing from the spirit and scope defined in the following claims.

What is claimed is:

1. A dot-matrix impact printer, comprising:

a print head including a piezoelectric element, and a print wire which is movable from a non-operated position thereof to an operated position thereof, due to displacement of the piezoelectric element, to produce an imprint on a surface of a recording medium, a distance between said non-operated position and the surface of said medium defining a head gap;

thickness sensing means for detecting a thickness of said recording medium; and a piezoelectric control device responsive to a wire activation command, for applying a controlled drive voltage to said piezoelectric element to thereby activate the print wire to said operated position, said piezoelectric control device comprising a static voltage control device and a dynamic voltage control device for controlling said drive voltage such that the controlled device voltage consists of a sum of a static voltage and a dynamic voltage which is applied to said piezoelectric element upon generation of said wire activation command, said static voltage control device increasing said static voltage with a decrease in the thickness of the recording medium detected by said thickness sensing means such that the static voltage does not cause the print wire to contact the surface of the recording medium, said dynamic voltage control device increasing said dynamic voltage with an increase in the detected thickness of the recording medium such that said print wire is impacted against the surface of the recording medium by a force corresponding to said dynamic voltage added to said static voltage.

2. A dot-matrix impact printer according to claim 1, wherein said piezoelectric control device updates said drive voltage according to the detected thickness of the recording medium, in response to trigger data indicative of a condition in which the thickness of the recording medium may be changed, said piezoelectric control device thereafter maintaining the updated static voltage.

3. A dot-matrix impact printer according to claim 2, wherein said trigger data consists of a print start command commanding initiation cf a printing operation, and said piezoelectric control device updates said static voltage, in response to said print start command.

4. A dot-matrix impact printer according to claim 1, wherein said piezoelectric control device comprises:

temperature sensing means for detecting a temperature of said piezoelectric element; and said static voltage control device is further for increasing said static voltage with an increase in the temperature detected by said temperature sensing means.

5. A dot-matrix impact printer according to claim 4, wherein said piezoelectric control device updates said static voltage according to the detected temperature of said piezoelectric element, each time a predetermined number of lines have been printed, said piezoelectric control device thereafter maintaining the updated static voltage.

6. A dot-matrix impact printer according to claim 1, wherein said piezoelectric control device comprises:

a first drive control device including a first DC power source of a variable voltage type connected in series to said piezoelectric element, and operable to apply to said piezoelectric element a voltage equal to a voltage across said first DC power source;

a second drive control device including (a) a second DC power source of a variable voltage type connected in series to said piezoelectric element, (b) a coil connected in series to said second DC power source and said piezoelectric element, and oscillatable with said piezoelectric element at a predetermined frequency, (c) charging control means operable between a first position for inhibiting said piezoelectric element from being charged, and a second position for permitting said piezoelectric element to be charged, said charging control means being normally placed in said first position, and being operated to said second position upon generation said wire activation command, and (d) voltage limiting means for inhibiting said piezoelectric element from being charged with an excessive electric energy from said second DC power source, which excessive electric energy causes the voltage across said piezoelectric element to exceed a predetermined upper limit which is higher than a voltage of said second DC power source, said first drive control device and said second drive control device being selectively operated; and a source voltage regulating device for controlling the voltage of said first DC power source to said static voltage, and controlling the voltage of said second DC power source to said sum of the static and dynamic voltages.

* * * * *